US005553322A

United States Patent [19]

Cebo-Johnson

[11] Patent Number: 5,553,322

[45] Date of Patent: Sep. 10, 1996

[54] WEIGHTED EXERCISING GARMENT

[76] Inventor: Mark Cebo-Johnson, 10 Harley St., London W1N 1AA, United Kingdom

[21] Appl. No.: 365,576

[22] Filed: Dec. 28, 1994

Related U.S. Application Data

[63] Continuation-in-part of PCT/GB93/01403, Jul. 5, 1993 published as WO94/01183.

[51] Int. Cl.[6] ..... A41D 1/06

[52] U.S. Cl. ..... 2/69; 2/79; 482/105

[58] Field of Search ..... 2/69, 79, 102, 2/115, 108; 482/105

[56] References Cited

U.S. PATENT DOCUMENTS

| | | |
|---|---|---|
| 4,268,917 | 5/1981 | Massey . |
| 4,382,302 | 5/1983 | Watson . |
| 4,384,369 | 5/1983 | Prince . |
| 4,396,190 | 8/1983 | Wilkerson . |
| 4,407,497 | 10/1983 | Gracie . |
| 4,602,387 | 7/1986 | Zakrzewski . |
| 4,632,389 | 12/1986 | Moss . |
| 4,658,442 | 4/1987 | Tomlinson et al. . |
| 4,905,991 | 3/1990 | Alston . |
| 4,953,856 | 9/1990 | Fox, III ..... 482/105 |
| 5,010,596 | 4/1991 | Brown et al. . |
| 5,048,125 | 9/1991 | Libertini et al. . |
| 5,075,902 | 12/1991 | McReynolds et al. . |
| 5,144,694 | 9/1992 | Conrad Da oud et al. . |

FOREIGN PATENT DOCUMENTS

| | | |
|---|---|---|
| 2129281 | 10/1982 | United Kingdom . |

*Primary Examiner*—C. D. Crowder
*Assistant Examiner*—Gloria Hale
*Attorney, Agent, or Firm*—Andrus, Sceales, Starke & Sawall

[57] ABSTRACT

A weighted exercising garment is formed in one piece of resilient flexible material so as to be a snug fit on the wearer's body. The garment comprises a central portion around the wearer's torso, an upper portion passing over the shoulders, and a lower portion extending downwardly from the central portion and including portions that pass around the thighs. Packs of weights are attached to the upper portion at the front over the chest and over the upper back, and further packs of weights are attached around the thighs. The weights, in the form of packs each having parallel pockets with a respective plurality of individual weights, are removably attached by a curly pile loop and hook material such as VELCRO (RTM). The garment forms part of a kit which includes two arm weight carriers worn around the wrists and two leg weight carriers worn around the calves.

12 Claims, 5 Drawing Sheets

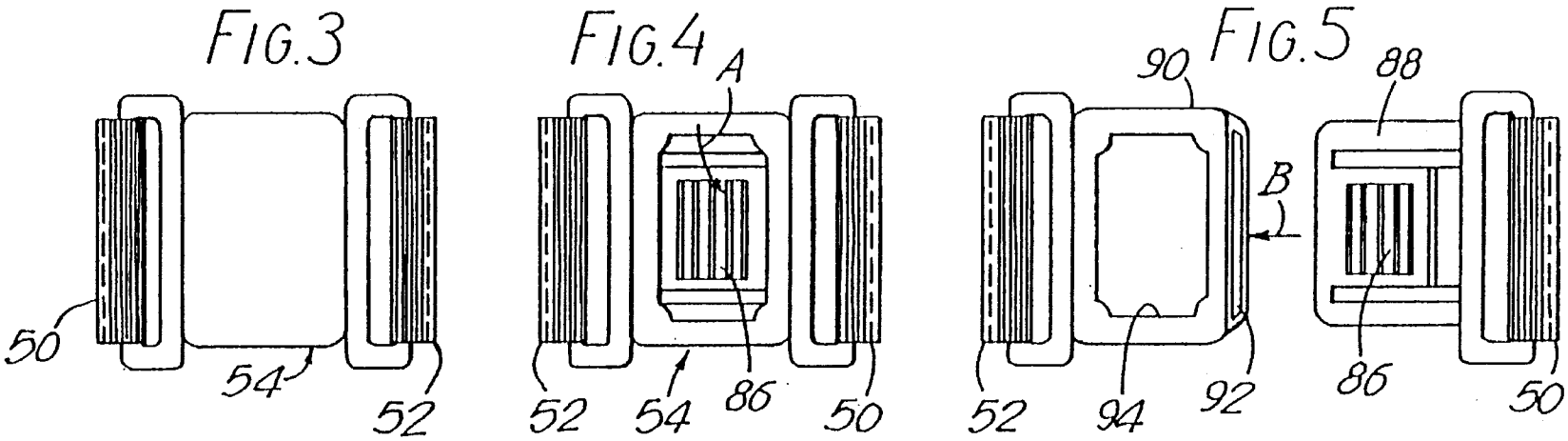
FIG. 3
50
54
52
FIG. 4
A
86
54
50
52
FIG. 5
88
86
50
B
90
94
92
52
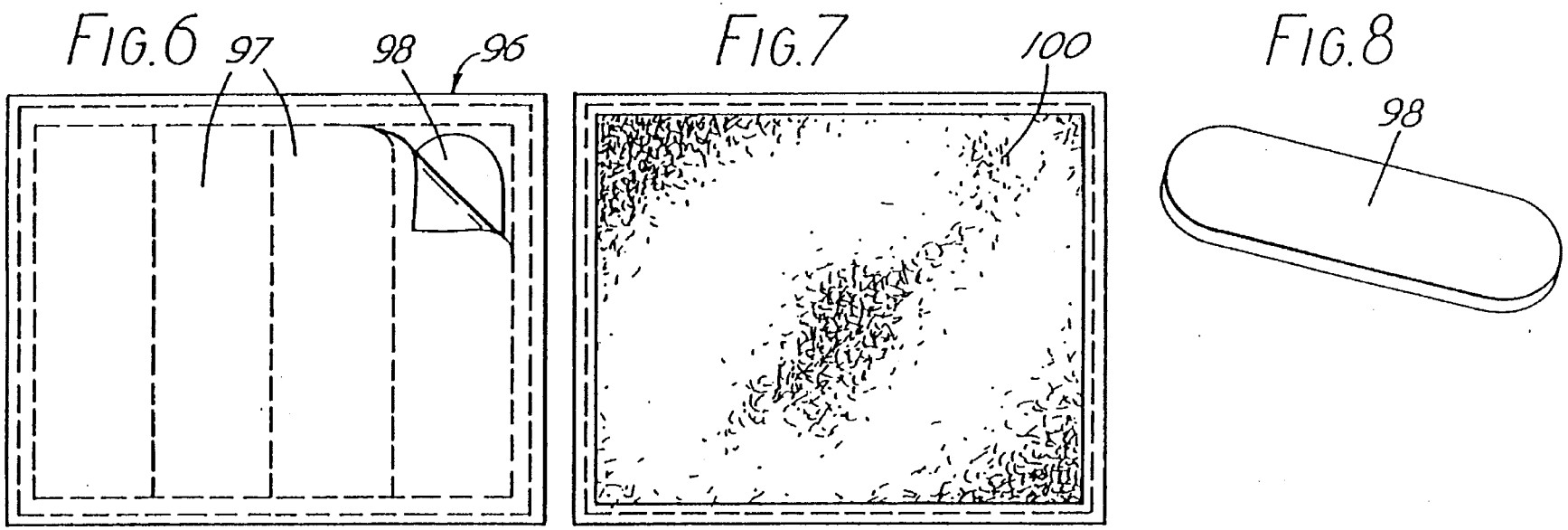
FIG. 6
96
98
97
FIG. 7
100
FIG. 8
98

WEIGHTED EXERCISING GARMENT

CROSS-REFERENCE TO RELATED APPLICATION

This application is a continuation-in-part of my International Patent Application No. PCT/GB93/01403, filed Jul. 5, 1993, publication No. WO94/01183.

BACKGROUND OF THE INVENTION

This invention relates to a weighted exercising garment, for use in exercising the human body as an aid to health and fitness.

It is well established that weight training, or resistance training, advances the performance of the body's muscle system, strength and stamina. A multitude of weighted devices have been developed for this purpose. For example, U.S. Pat. Nos. 4,602,387 and 4,268,917 disclose loose-fitting vests with pockets that can be filled with weights, and U.S. Pat. No. 4,658,442 and united Kingdom Patent Application GB-A-2 129 281 show similar vests with weight-filled pockets which are made more snugly fitting by horizontal straps that can be tightened on the user.

U.S. Pat. No. 4,382,302 describes a similar sort of vest with horizontal straps which pass round the wearer's torso and can be tightened to hold the vest snugly in contact with the wearer's chest and back. A number of flat weights are attached as desired to the front and back panels of the vest by the use of curly pile loop and hook fastener material as sold under the registered trade mark VELCRO. Thus weights can be added or removed as desired for an individual's training schedule.

U.S. Pat. No. 4,384,369 reverts to a loose fitting exercise suit comprising a separate jacket and pants, with numerous pockets which carry bags of liquid to provide the desired weights. The pockets cover the torso, the arms from shoulder to wrist, and the legs from crutch to ankle. It is stated that instead of being formed as a two-piece suit, the suit may be constructed as a one-piece jump suit. With this suit the user can apparently carry up to of the order of 200 lbs (90 kg) weight, but this amount distributed in the unplanned manner described would not serve any useful exercising function, and would at the least be unbearably uncomfortable and could be positively dangerous.

To the present inventor's knowledge none of the above-mentioned exercise garments have actually been satisfactory for widespread use. Despite the plethora of pockets they do not provide a distribution of weights which strengthens the required muscles properly. Furthermore they are inconvenient to wear as, despite measures purporting to inhibit it, they still move around on the body and do not give the wearer the confidence that they are going to stay put during hard physical exercise. Finally, many of the garments are inelegant and out of keeping with modern sports environments.

SUMMARY OF THE INVENTION

An object of the invention is to provide a weighted exercise garment which is comfortable to use, in that freedom of movement of the user is not restricted and good ventilation is provided while the garment and the weights attached to it are firmly retained in position relative to the user's body.

A further object of the invention is to provide a weighted exercise garment which is an effective aid to training, the sites of weights on the user's body being selected for optimum training effect.

The present invention in its various aspects is defined in the appended independent claims, to which reference should now be made. Advantageous features of the invention are set forth in the sub-claims.

Preferred embodiments of the invention are described in more detail below with reference to the drawings. A first preferred embodiment takes the form of a one-piece garment of resilient flexible material which is a snug fit, when worn, on the wearer's body. The garment comprises a central portion around the wearer's torso, an upper portion passing over the shoulders and linked by two upper side portions to the central portion, and a lower portion below the central portion comprising thigh portions that pass around the thighs and lower side portions linking the thigh portions to the central portion. Cut-out regions are defined above the central portion at the front and rear of the torso of the wearer and below the central portion over the crutch of the wearer. Packs of weights are attached to the upper portion at the front over the chest and also over the upper back, and further packs of weights are attached around the thighs. The weights are securely but removably attached by a bonding fastener material which is self-fastening but readily releasable, for example a curly pile loop-and-hook fastening material, such as that sold under the registered trade mark VELCRO.

The garment of this embodiment forms part of a kit which includes two arm weight carriers worn around the wrists and two leg weight carriers worn around the calves.

Preferably the packs of weights are usable on the garment or on the arm and leg weight carriers, and each comprises a holder made of fabric, the holder having a plurality of parallel pockets each containing an individual weight in this way the weights can conform to some extent to the shape of the body and are therefore more comfortable to wear during exercise and are more securely attached by the fastening material. Advantageously, the lead weights are made sufficiently soft and thin that the weight packs can not only flex perpendicular to the elongate weights but also along the length of the weights as the weights themselves can bend. This may be of particular value in rendering the exercise garment practical for use in many forms of exercise, such as floor exercises and contact sports, where more bulky, protruding weights would be of little value.

Furthermore the weights can be removed or interchanged so that the total weight and the weight distribution can be varied as desired for the individual user.

It is of course very well-known to produce wet-suits and the like which encase the user from shoulders to ankles but which are formed of a resilient flexible material, such as to be a snug and comfortable fit on the wearer's body and yet be quite sufficiently secure for wear during active water sports such as sailing or board-sailing. Materials akin to those used for such wet-suits can be used to make an exercise garment in accordance with the present invention.

Development by the inventor of the exercise garment defined in the claims of this application, and described herein with reference to preferred embodiments of the invention, has shown that the cut-out regions are surprisingly important. An object of the garment is to enable the use of weights firmly supported on the body to enhance the effect of a wide variety of exercises. It thus combines the two forms of exercise most popular at present, namely aerobic exercise and weight training. Although the garment was designed with floor exercise in mind, it may be used advantageously for many purposes, such as in conjunction with sports, including even contact sports such as American Football, judo, karate or the like. Consequently it is crucial that the weights are firmly retained in place during use while the weight-carrying garment restricts the movement of the wearer as little as possible. During exercise, considerable freedom of movement is required, in particular at the torso and hip areas, and it is in these areas that the cut out regions have been found to greatly enhance the flexibility of the garment and comfort in use.

The exercise garment of the invention may therefore be valuable and effective training aid and, when suitably weighted, may improve training towards strength, elasticity and endurance. Because it provides freedom of movement combined with secure weight support, it can be incorporated into almost any sport or exercise activity, and by the addition of progressively greater weights may also provide a good way to monitor a user's progress over time. It may also be used with different weights for different users to handicap users of different fitness or strength to enable them to compete directly with each other. These aspects, combined with the modern design and appearance of the exercise garment, may strongly motivate and inspire a user and enrich otherwise monotonous regular training.

With light weights, or weights in specific locations only, the suit may also be effective in physiotherapy in helping a user to recover from injury or stroke or the like.

Another important feature of the garment provided by the cut-out regions is that ventilation is enormously enhanced, greatly increasing comfort for the user while exercising. A second aspect of this is that the exercise garment is intended to be worn over exercise clothing, as will be clear from a consideration of the drawings hereinbelow. This, combined with the excellent ventilation and comfort of use means that the garment may be worn by more than one person, for example in a health club environment, without users feeling that they are compromising their personal hygiene. This is in keeping with today's increasing awareness of personal health and hygiene.

It is important that the weights applied to the exercise garment are suitably positioned in relation to the body of the user for good training effect. Advantageous sites have been selected as follows:

Upper Back Sites

A weight pack can be situated just below each shoulder. These sites have been selected for their effectiveness. For example, when lying on the floor completing a sit-up movement, the upper back may not flex as much as the middle back, so positioning weights on the upper back may give more freedom of movement. This applies similarly to most other forms of exercise. The height of the weights on the upper back also allows the overall weight to be distributed through the back muscles and spine.

Upper Front Torso Sites

One weight pack can be situated just below each shoulder over the pectoral muscle. These sites have been chosen to minimise restriction of movement of the chest area during exercise, for both men and women. The exercise garment is designed to move as an extension of the body. In combination with the upper front cut-out region, the positioning of the weights over the pectoral muscles is of particular value to women as the weights are securely positioned whilst breast movement is not restricted.

Lower Body Sites

These sites were chosen to add maximum resistance to the legs for training without restricting the movement of the user. Freedom of movement is further enhanced by the cut-out region.

The shaping of the exercise garment of the invention may thus advantageously combine freedom of movement, comfort during use, and the effective siting of weights. The upper back and upper front weight sites may conveniently be provided by the front and rear of the upper portion of the exercise garment, while the upper side portions maintain the necessary tension in the garment to prevent movement of the weights relative to the user's body. Similarly, the lower body sites may conveniently be provided by the thigh portions of the garment, while the lower side portions apply the necessary tension to the thigh portions of the garment to prevent the thigh portions slipping downwards during exercise. Thus the weights may be supported in position solely by the fabric of the garment by virtue of the shape of the garment and its snug fit on the body of the user. At the same time, the combination of the cut-out regions and the corresponding side portions maximises the freedom of movement and comfort of the user, especially during twisting or running motions for example.

BRIEF DESCRIPTION OF THE DRAWINGS

The invention will now be described in more detail, by way of example, with reference to the drawings, in which:

FIG. 3 is a front view of the clasp used at waist and chest in the garment of FIG. 1;

FIG. 4 is a rear view of the clasp when closed;

FIG. 5 is a rear view of the clasp when open and about to be closed;

FIG. 6 is a front view of one of the weight packs used on the garment;

FIG. 7 is a rear view of the weight pack of FIG. 6;

FIG. 8 shows one of the weights;

FIG. 12 shows at (a) and (b) similar views of the portion for use on the calves of the legs;

DETAILED DESCRIPTION OF THE PREFERRED EMBODIMENTS

Figure 1:
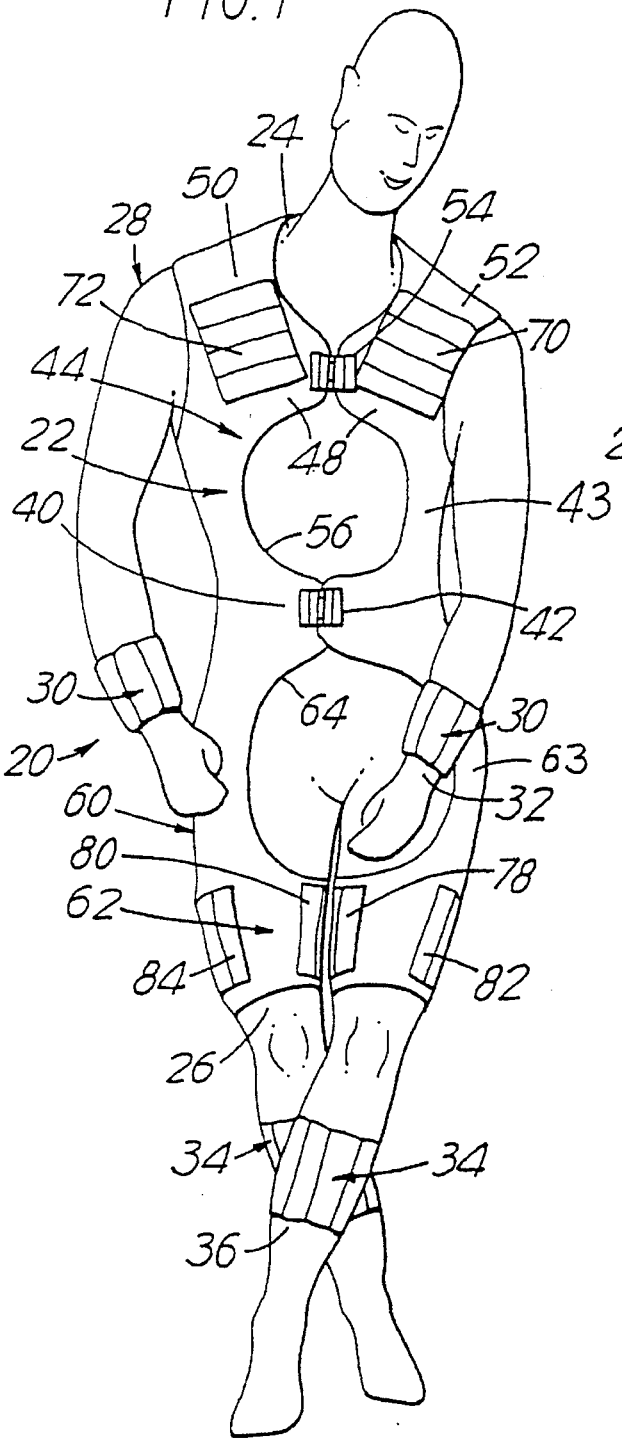
FIG. 1 is a front view showing a first weighted exercising kit embodying the invention being worn by a user.
Figure 2:
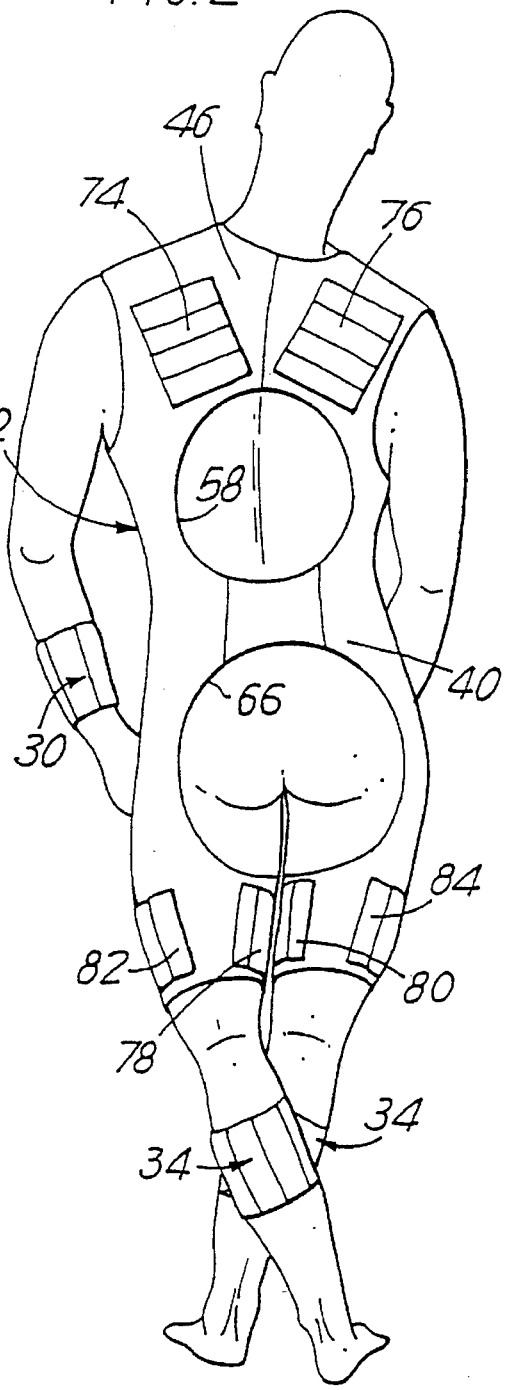
FIG. 2 is a back view corresponding to FIG. 1.

The preferred embodiment of the invention is illustrated in FIGS. 1 to 10 of the drawings and reference is first made to FIGS. 1 and 2 which are respectively front and back views of the first weighted exercising kit being worn by a user.

The kit 20 comprises a main exercising garment 22 formed by a resilient flexible material and extending from the shoulders 24 to the thighs 26 of the user 28. In addition the kit includes two arm weight carriers 30 which are worn around the wrists 32 respectively, and two leg weight carriers 34 which are worn around the user's lower leg, more particularly around the calves 36.

The main garment itself is a one-piece suit and comprises a central portion 40 which is worn around the user's torso and is held at the waist by a clasp 42. Integral with this and extending upwardly from the central portion 40 via two side portions 43 is an upper portion 44 which passes over the user's shoulders 24 and provides a rear upper panel 46 and a front upper panel 48 in two pares 50,52 which are also held together by a clasp 54. Between the two clasps 42,54 at the front there is a cut-out region 56, and an the back there is a corresponding cut-cut region 58. The front upper panel 48 thus is over the user's chest and the rear upper panel 46 is over the user's upper back.

Extending downwardly from the central portion 40 is a lower portion 60 integral with the central portion 40. This lower portion 60 includes two thigh portions 62 which extend as a tight fit around the user's thighs 26, to provide short-legged portions in the manner of a pair of shorts, terminating just above the knees, and two side portions 63 linking the central portion 40 to the thigh portions 62. To lighten the material, to provide for ease of movement and for ventilation there is a cut-out region 64 over the crutch at the front merging into a cut-out region 66 over the buttocks at the back.

Attached to various places on the garment are a number of pieces of curly-pile loop-and-hook fastener material such as that sold under the registered trade mark VELCRO. The locations where such pieces of material are attached are as follows. Two pieces 70,72 are attached to the front upper panel 48, to left and right of the clasp 54 respectively. Two pieces 74,76 are attached to left and right respectively on the rear upper panel 46. Further pieces are attached around the thighs. As shown pieces 78,80 are attached to the inside of the left and right thighs respectively, and pieces 82,84 are attached to the outside of the left and right thighs respectively.

The two fasteners 42,54 are identical in construction and are illustrated in FIGS. 3 to 5. As seen in FIG. 3, the closed clasp presents a plain face to the exterior. On the inside, however, there is access to a resilient flap 86 which, when depressed as shown by the arrow A, allows the clasp to be opened. As best seen in FIG. 5, the right-hand side of the clasp comprises a tongue 88 carrying the flap 86 on its rear face. The left-hand side of the clasp comprises a box 90 which has a slot opening 92 to receive the tongue when moved into it in the direction of the arrow B and a cut-out 94 in its rear face to receive the flap 86, thus securing the tongue in the box. Any other suitable clasp could be used. The fasteners 42,54 could be replaced by zipper fasteners, for example.

The weights are in the form of weight packs of which an example 96 is shown in FIGS. 6 and 7. The pack 96 is made from a fabric and stitched so as to provide four pockets 97 as shown in FIG. 6. Purely for illustration one pocket is shown open with the weight 98 in position, though they will normally be sewn and sealed closed. The weights 98 are flat and elongate, generally rectangular with rounded ends as shown in FIG. 8, and can be made of lead coated with a plastics material. By having a plurality of weights in each pack, for example from three to six individual weights (four in the example shown), the weights can conform to some extent to the human shape, and thus the fastener material holds them on better, and having a degree of flexibility they move easier with the body when exercise is performed. To this end the back of each pack is formed by fastener material 100 which mates with the pieces of material 70–84 on the garment. Typically two different types of weight packs are made, one containing four 3 oz or 75 g weights and the other containing four 5 oz or 125 g weights, or alternatively 6 oz or 150 g weights.

Figure 9:
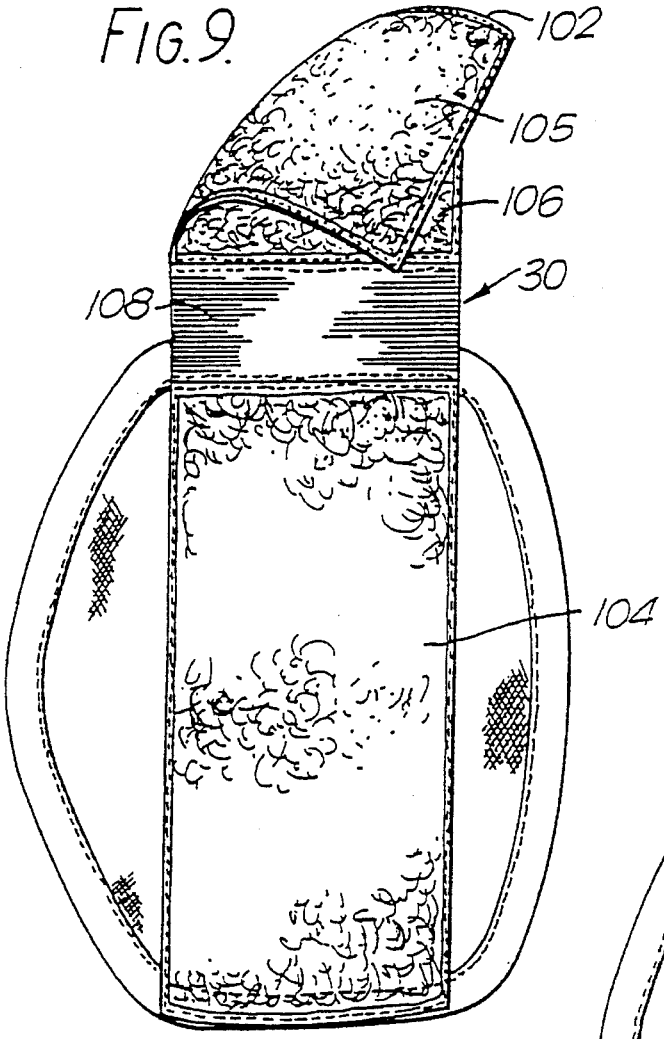
FIG. 9 illustrates one of the arm weight carriers for wear around the wrist.
Figure 10:
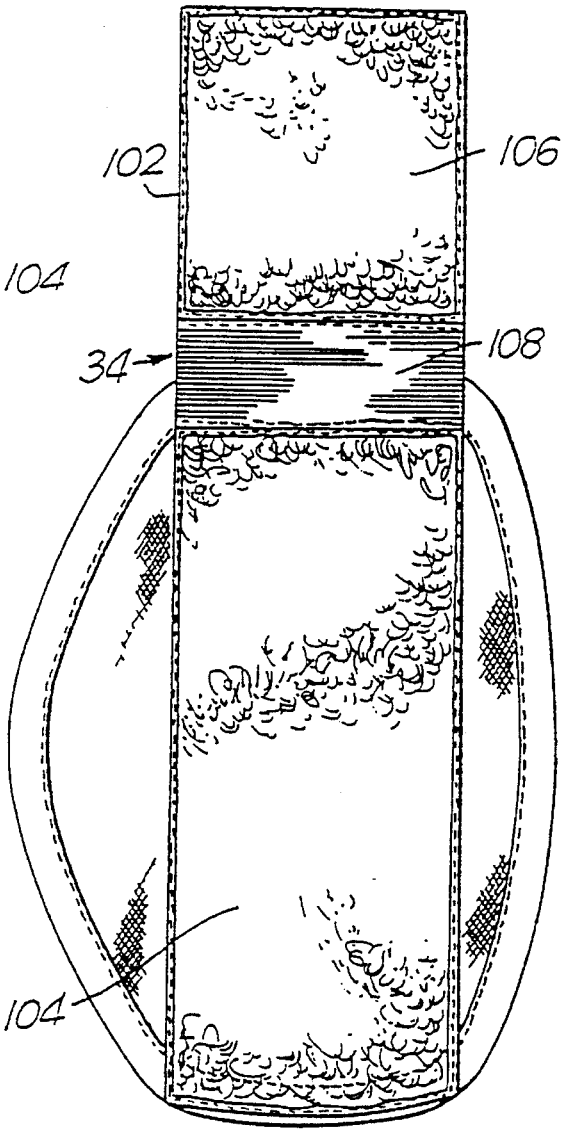
FIG. 10 illustrates one of the leg weight carriers for wear around the calf.

The arm weight carriers 30 and leg weight carriers 34 are as shown in FIGS. 9 and 10 respectively. Each basically consists of an elongate strip 102 carrying a piece of fastening material 104 on the outer surface at one end, and a corresponding piece of material 105 on the inner surface at the other end. At this other end, a further piece of fastening material 106 may also be provided. The fastening material 104 (and/or 106) also receives a weight pack 96. An elastic section 108 is in the middle of the strip 102. The strip 102 can be wound around the wrist or calf and fastened with the fastening material. This then acts as a carrier to which a weight pack or packs can be attached using the fastener material 104. The elasticated sections 108 allow such carriers to fit all sizes and yet to be secured tightly.

Thus the weight packs are altogether sited in five areas around the body. They cover the upper body sections, namely the front chest and upper back. Weights can thus be placed on the front on the pectorals and on the trapezius muscles of the upper back. This enables the weights to be spread over the upper part of the body. The arm weights are placed on the underside of each wrist and cover the extensor muscles. The upper leg weights, on the thighs, are located on each side of the quadriceps, both outside and inside, on both legs. Finally, the lower leg weights are attached over the calf muscle.

Twelve weight packs can thus be carried by the kit. If a complete set of 3oz (75 g) weights is used, this gives a total weight of 9 lbs (3.6 kg). With 6 oz (150 g) weights, the total can be doubled. The kit adds resistance to all forms of exercise. It is suitable for use with many types of exercise because of its tight fit, being formed of an elasticated fabric. The suit moves with the body, and the weights are strategically placed to supply resistance to the body in total, and not just to the areas that they are sited on. This is especially useful for floor exercises such as press-ups, sit-ups, and squat thrusts, for example.

Because the suit passes over the shoulders and also fits tightly around the thighs, while being a snug fit around the torso in between, it provides a secure framework to which the weights may be fixed. Unlike a vest, the suit does not risk riding up on the body and thus becoming uncomfortable and also feeling insecure, but rather is anchored firmly around the user's body.

The weights are located at positions where they not only exercise the proper muscles, but also so that they do not flap about as the user exercises. To this end the upper body weights are placed high on the body, quite near to the shoulders, both at front and back. The weights on the thighs are quite close to the knees, and are placed as shown in FIGS. 1 and 2 to either side of the knee. This is now preferred to the arrangement shown in the second embodiment, described below, where they are placed on the top of the knee. The lower leg weights are placed well up the calf; for best effect they should not be positioned down close to the ankle.

The kit can be used with all the weights in place, or with only some of them. For example, if used for remedial work, such as after a knee injury or following orthopaedic surgery to the knee, the kit could be put on while just fixing leg weights, and the treatment carried out specifically to that area. As the injury improves, heavier weights can be added to strengthen and aid the improvement. Thus the kit can be used to be an aid either to the body as a whole or to specific muscle groups, either for exercise to develop fitness, or for remedial exercise to repair injuries.

In certain circumstances the suit 22 can be used on its own or with only the arm weights and not the leg weights, or vice versa. The suit 22 is relatively easy to put on with the clasps 42,54 open, but is tightly secured as a snug fit on the user once they are fastened.

The fabric used to make the suit 22 can comprise a layer of rubber sandwiched between layers of polyester and nylon, and in any event the fabric will be strong but stretchable. In particular a preferred fabric can consist of 44% cotton, 42% nylon and 14% lycra.

While several types of stretch fabric could be used, material of the type used to make wetsuits can conveniently be used, for example, a smooth-skin Neoprene (Registered Trade Mark) type of material. The total thickness of fabric can be about 7 mm.

The above preferred embodiment has the suit 22 formed in a single piece, though it may be manufactured from separate sections sewn or bonded together. Alternatively, the suit could be formed with separate jacket and shorts which are attached to each other about the waist, and this is the case in the second embodiment.

Figure 11:
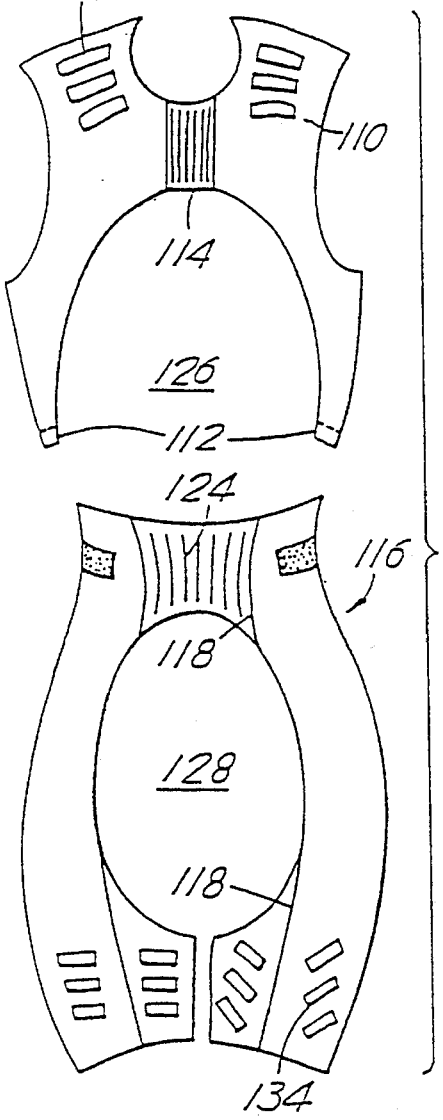
FIG. 11 is a front view showing a second weighted exercising garment embodying the invention.
Figure 12:
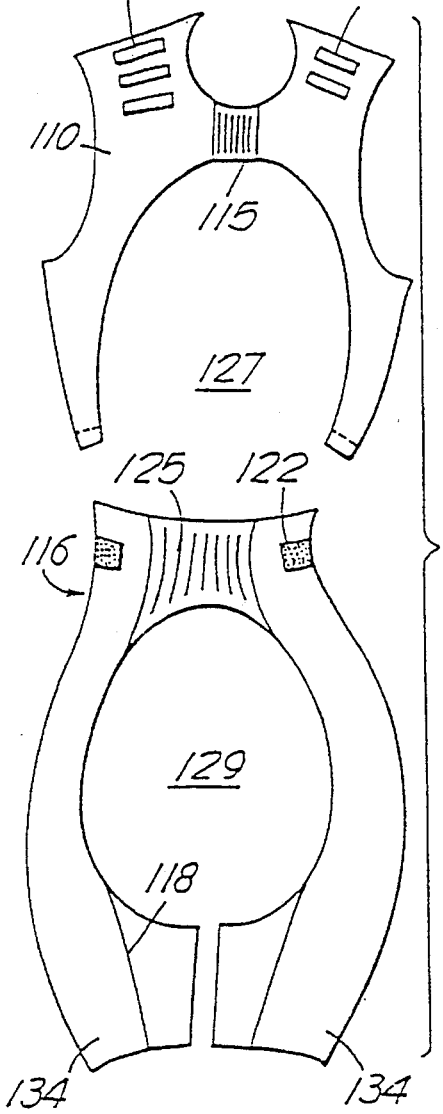
FIG. 12 is a back view corresponding to FIG. 11.
Figure 13:
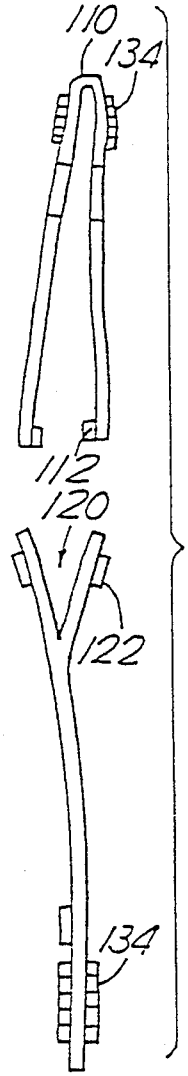
FIG. 13 is a side view of the garment of FIG. 11.
Figure 14A:
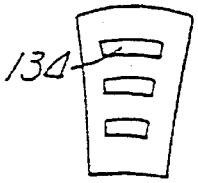
FIG. 14 shows at (a) and (b) front and back views respectively of a portion of a kit including the garment of FIG. 11 for use on the biceps of the arm.
Figure 14B:
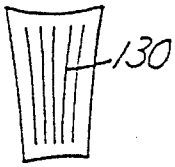
Figure 15A:
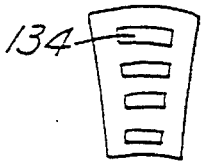
Figure 15B:
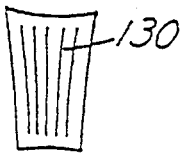
Figure 16:
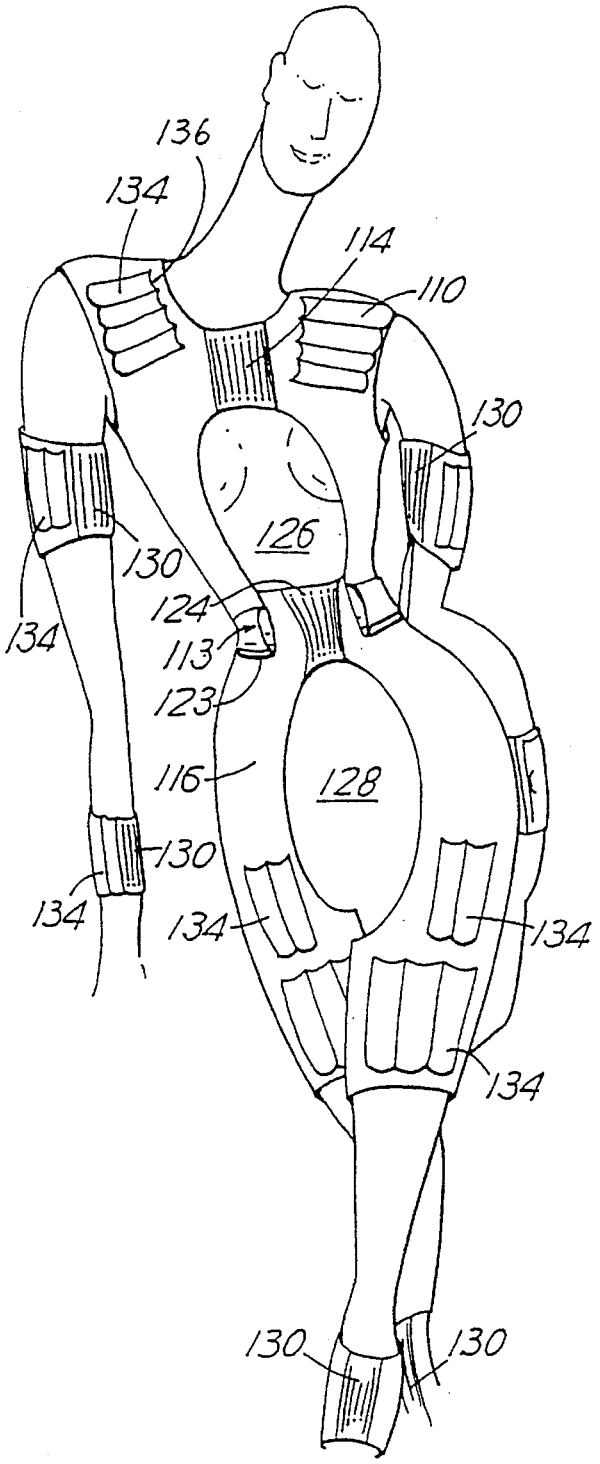
FIG. 16 is a front view showing the kit being worn.
Figure 17:
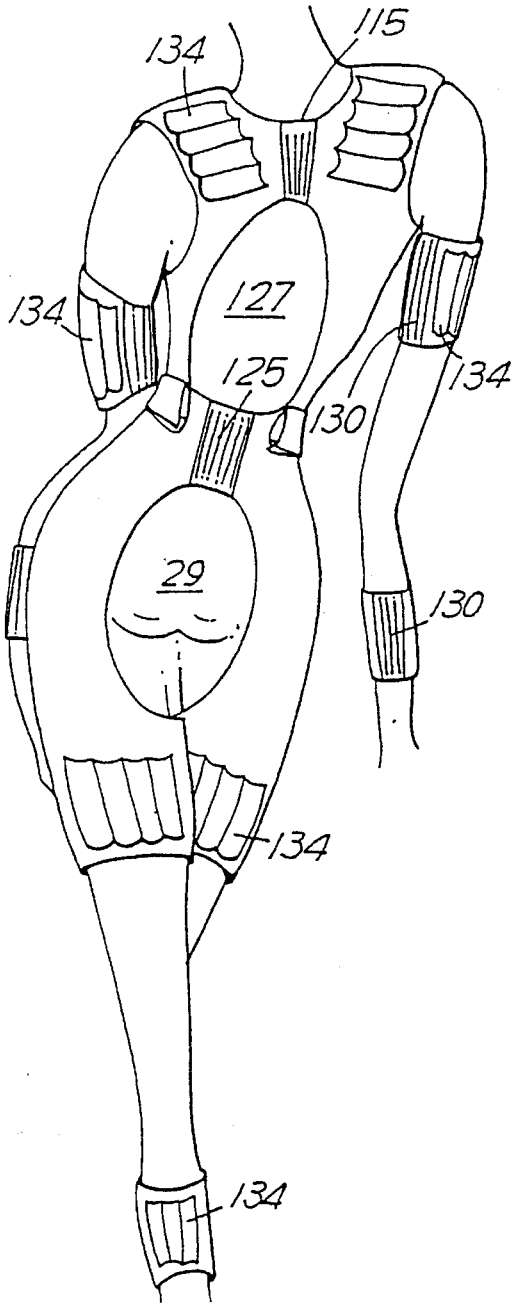
FIG. 17 is a back view corresponding to FIG. 16.

Referring to the second embodiment of FIGS. 11 and 12, it is seen that the upper body portion 110 covers the front of the chest, including the pectoral and trapezius muscles and is shaped like a vest and has attachment means at its lower end at 112. Each portion has central elasticated portions 114 and 115 in the front and rear, for comfort and access. The lower body portion 116 is preferably made from a number of pieces of material joined at the seams 118 and the upper part thereof opens at 120 as seen in FIG. 13, so as to assist the wearer in getting into this portion. Attachment means are provided at 122, e.g. a piece of bonding fastener 122 for co-operation with the corresponding means 112 on the upper portion, or a tongue 113 passed through a slot or loop 123 and folded back and secured to itself, as shown in FIGS. 16 and 17. The body portions 110 and 116 do not need to extend over the whole torso and can have a central gap, or cut-out regions, 126,127,128,129 as shown. Each portion is designed to be stretched around the respective part of the body so it fits tightly over the contours of the muscles of that part of the body.

The portions for the arm and leg, as shown in FIGS. 14, 15, 16 and 17, are each elasticated at 130 and do not require any fastening means. The portions of the kit for use on the other parts of the arm and leg will be shaped similarly to those shown in FIGS. 14 and 15, but of appropriate size, as seen in FIGS. 16 and 17.

In the areas indicated as 134 in respective areas of each portion of the kit, there are sewn on a series of elongated pockets made of fabric of adequate strength to hold lead weights; means are provided at 136 to secure the pockets closed, e.g. bonding fasteners, buttons or hooks and eyes. The pockets and weights can be placed e.g. upright or at an angle to the vertical or horizontal as variously shown in FIGS. 11 to 17, provided that the weights will be held in the pockets.

Additional elasticated portions could be provided in other areas of the kit if desired.

After the wearer has put on the kit, he can exercise in any desired manner, including carrying out a sport such as running, and the weights in the kit will put increased resistance on the respective groups of muscles. The kit may also be used by those who have undergone orthopaedic surgery and need remedial treatment. The number of weights used can be increased as exercise proceeds. Purely as an example for an average adult male, suitable sizes of the weights are up to 2 kilograms or more for the upper body or for the lower body, and ½ kilogram each on the upper and lower arms (2 kilograms total on the arms) and 2 kilograms on each thigh and ½ kilogram on the lower legs; a total weight could be 4 kilograms. The garment or body kit can be provided in appropriate differing sizes, for persons of differing sizes, and for men and women.

I claim:

1. An exercising garment for carrying weights, formed of a resilient, flexible material and having, in use;

a central portion worn around the torso or waist of a user;

an upper portion passing over the user's shoulders and having a front upper panel portion over the user's upper chest and a rear upper panel portion over the user's upper back;

two upper side portions linking the central portion to the upper portion;

two respective thigh portions positioned around the user's thighs;

two lower side portions, each linking the central portion to a respective thigh portion; and means for removably carrying weights provided on the front and rear upper panel portions and the thigh portions; wherein a front cut-out region is defined above the central portion between edges of the central portion, upper side portions and front upper panel portion;

a rear cut-out region is defined above the central portion between edges of the central portion, upper side portions and rear upper panel portion; and a lower cut-out region is defined below the central portion over the crutch of the user, between edges of the central portion, lower side portions and thigh portions;

the garment being a snug fit on the user's body.

2. A garment according to claim 1, in which the garment is constructed as a one-piece suit.

3. A garment according to claim 2, comprising, for ease of putting on and removing the suit;

a first releasable fastener in the central portion at the waist of the user; and a second releasable fastener in the front upper panel portion at the chest of the user.

4. A garment according to claim 1, in which the garment is constructed as a two-piece suit which includes:

a jacket portion comprising said upper side portions, said front upper panel portion and said rear upper panel portion; and a shorts portion comprising said central portion, said lower side portions and said thigh portions;

said upper side portions of said jacket portion being releasably fastenable to said central portion of said shorts portion.

5. A garment according to claim 1, in which the means for removably carrying weights comprises bonding fastener material which is readily releasable.

6. A garment according to claim 1, further comprising a plurality of weights which the garment is adapted to carry, the weights being in the form of packs each comprising a fabric holder with a plurality of parallel pockets each for containing a respective weight.

7. A garment according to claim 1, in which the garment is formed of material comprising a layer of rubber between layers of polyester and nylon.

8. A garment according to claim 1, in which the means for removably carrying weights is provided so that, in use, weights are positionable on the front upper panel portion on the pectorals, on the rear upper panel portion on the trapezius muscles of the upper back and on the thigh portions on each side of the quadriceps, inside and/or outside the thighs.

9. An exercising kit comprising;

an exercise garment formed of a resilient flexible material and extending, in use, from the shoulders to the thighs of a user;

two arm weight carriers for fitting around the wrists of the user; and two leg weight carriers for fitting around the lower legs of the user;

the exercise garment having;

a central portion worn around the torso or waist of a user;

an upper portion passing over the user's shoulders and having a front upper panel portion over the user's upper chest and a rear upper panel portion over the user's upper back;

two upper side portions linking the central portion to the upper portion;

two respective thigh portions positioned around the user's thighs;

two lower side portions, each linking the central portion to a respective thigh portion; and means for removably carrying weights provided on the front and rear upper panel portions and the thigh portions; wherein a front cut-out region is defined above the central portion between edges of the central portion, upper side portions and front upper panel portion;

a rear cut-out region is defined above the central portion between edges of the central portion, upper side portions and rear upper panel portion; and a lower cut-out region is defined below the central portion over the crutch of the user, between edges of the central portion, lower side portions and thigh portions;

the garment being a snug fit on the user's body;

each arm weight carrier comprising;

a releasable fastening for removably fitting the arm weight carrier around a wrist of the user; and, a means for removably carrying a weight;

and each leg weight carrier comprising;

a releasable fastening for removably fitting the leg weight carrier around a lower leg of the user; and a means for removably carrying a weight.

10. An exercising kit according to claim 9, in which the arm and leg weight carriers are elongate with spaced sections of releasable fastening material thereon and an elastic portion between the fastening sections so that they are fastenable around the wrist or lower leg.

11. An exercising kit according to claim 9, in which the weights carried by the arm and leg weight carriers are in the form of packs each comprising a holder of fabric material, the holder having a plurality of parallel pockets each for containing a respective weight.

12. An exercising garment for carrying weights, formed of a resilient flexible material and extending, in use, from the shoulders to the thighs of a user and comprising a front upper panel over the user's upper chest and a rear upper panel covering substantially the user's entire upper back, the garment being a snug fit on the body of a user, and there being defined in the garment;

a front cut-out region at the lower chest and torso of the user;

a rear cut-out region centrally disposed at the lower back of the user; and a lower cut-out region at the crutch of the user.

* * * * *